US005865663A

United States Patent [19]

Liao

[11] Patent Number: 5,865,663

[45] Date of Patent: Feb. 2, 1999

[54] TOY SUBMARINE BALLAST SYSTEM

[76] Inventor: Hsin-Chun Liao, Southern Ave., Tempe, Ariz. 85283

[21] Appl. No.: 858,580

[22] Filed: May 19, 1997

[51] Int. Cl.[6] ..... A63H 23/04; A63H 23/08; B63G 8/22; B63B 22/20

[52] U.S. Cl. ..... 446/155; 446/158; 446/161; 114/333; 441/29

[58] Field of Search ..... 446/153, 155, 446/158, 159, 161, 267; 441/28, 29; 114/121, 125, 333; 604/96

[56] References Cited

U.S. PATENT DOCUMENTS 754,222 3/1904 Lake ..... 114/333
3,943,869 3/1976 Frechette ..... 114/333
4,187,796 2/1980 Ess ..... 114/312
4,448,409 5/1984 Kaga et al. ..... 446/267
5,484,411 1/1996 Inderbitzen et al. ..... 604/96

*Primary Examiner*—Robert A. Hafer
*Assistant Examiner*—Laura Fossum

[57] ABSTRACT

A ballast system for toy submarines comprises a plumbing device, a flexible bag, a piece of wire and a rod. The ballast system draws water in and forces water out by decompressing and compressing the flexible bag.

14 Claims, 5 Drawing Sheets

TOY SUBMARINE BALLAST SYSTEM

BACKGROUND OF INVENTION

Ballast systems which enable boats to dive and surface have been employed in real submarines, industrial submersibles and radio controlled submarines for professional modelers. In many of these cases, structural integrity at high pressure and precise volume control of the ballast tank are often required to operate the ballast system properly in hostile environment such as a deep sea. Therefore, they often require complicated and expensive structures. High pressure air or sometimes chemicals are used in these systems to pump water out of ballast tanks. When such systems are being used in toy submarines, they are not safe for children.

The present invention is intended for toy submarines which are to be operated in the bath tub, swimming pool, or other shallow water. Accordingly, several objects of my invention are to provide an easily manufacturable device which performs diving and surfacing maneuvers and is safe for children.

DESCRIPTION OF DRAWING

Figure 1:
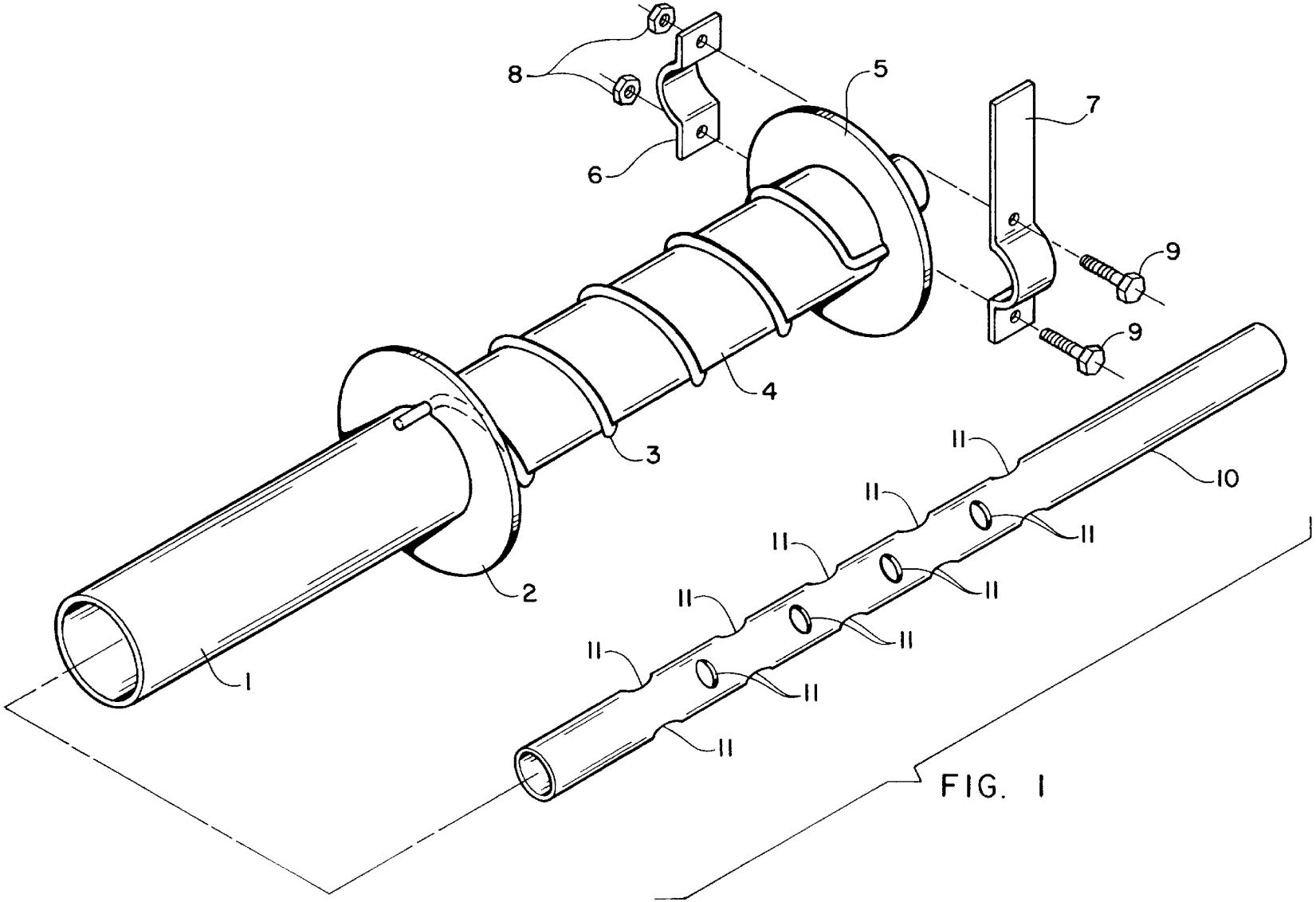
FIG. 1 is an exploded front perspective view of the present invention.

1. Tube
2. Front Stop Plate
3. Wire
4. Flexible Bag
5. Rear Stop Plate
6. Mounting Bracket
7. Connecting Rod
8. Nuts
9. Bolts
10. Guiding Rod
11. Holes of the guiding rod
12. Electrodes of the chain driving unit
13. Holes
14. Chain
15. Sprocket
16. Chain Driving Unit
17. Batteries for the driving unit
18. External hull
19. Front External hull half
20. Rear External hull half
21. Pressure hull
22. Front pressure hull half
23. Rear pressure hull half
24. Electric wire pair for the chain driving unit
25. Propulsion motor
26. Electric wire pair for the propulsion motor
27. Batteries for the propulsion motor

DESCRIPTION OF THE PREFERRED EMBODIMENT

Referring to FIG. 1, the tube 1 and the flexible bag 4 form the main body of the ballast system. One end of the tube 1 is to be used as a nozzle for water to enter the system. The other end is fitted into the opening of the flexible bag 4. Adhesives, clamps, industrial processes can be applied to the overlapping area between the outer surface near the end of the tube 1 and inner surface of the opening of the flexible bag 4 to prevent water from leaking out of the ballast system.

A shielded wire 3 is glued spirally around the flexible bag 4. The wire is used to control the shape of the flexible bag 4. For example, it stops the flexible bag 4 from over expanding at deep water. It also forces the skin of the bag to be folded more properly when it is compressed.

The guiding rod 10 is longer than the flexible bag 4. The guiding rod 10 is installed inside the flexible bag 4. It is hollow inside and has holes 11 on its surface to allow water to enter or leave the ballast system more efficiently. One end of the guiding rod 10 is clamped to the end of the flexible bag 4 by the mounting bracket 6 and the connecting rod 7. The other end is inside the tube 1. When the flexible bag 4 is compressed or decompressed, the guiding rod 10 slides back or forth inside the tube to force the flexible bag 4 to move along the same direction as the length as the tube. A front stop plate 2 is mounted at about the junction of the tube and the flexible bag. A rear stop plate 5 is mounted at the end of the flexible bag 4 against the connecting rod. When the flexible bag is compressed, the folded skin of the flexible bag is confined in between the front stop plate 2 and rear stop plate 5. So water in the flexible bag can be emptied more completely.

Figure 2:
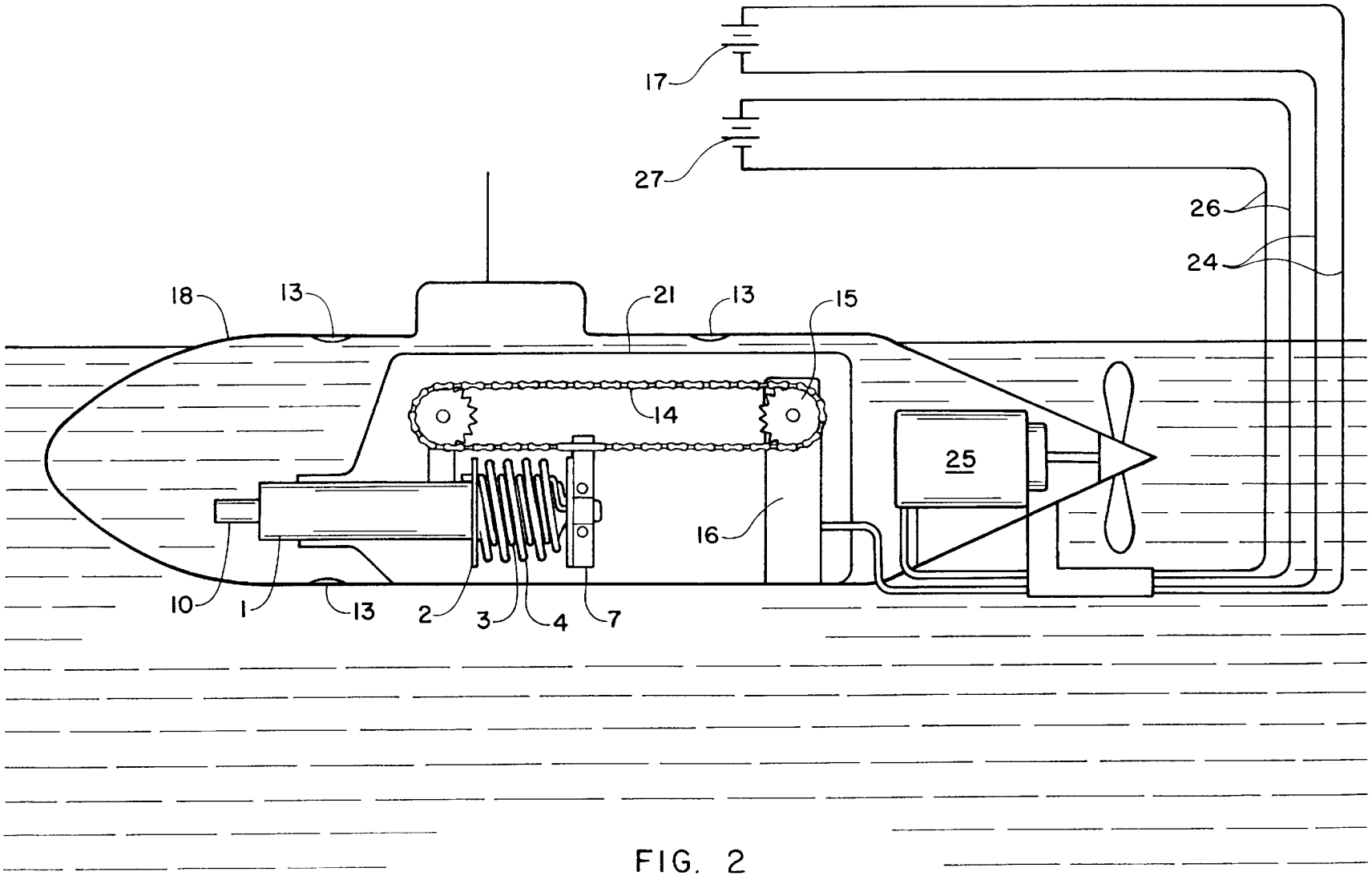
FIG. 2 is a cross-sectional side view showing the operation of the invention when being used in surfacing the toy submarine.
Figure 3:
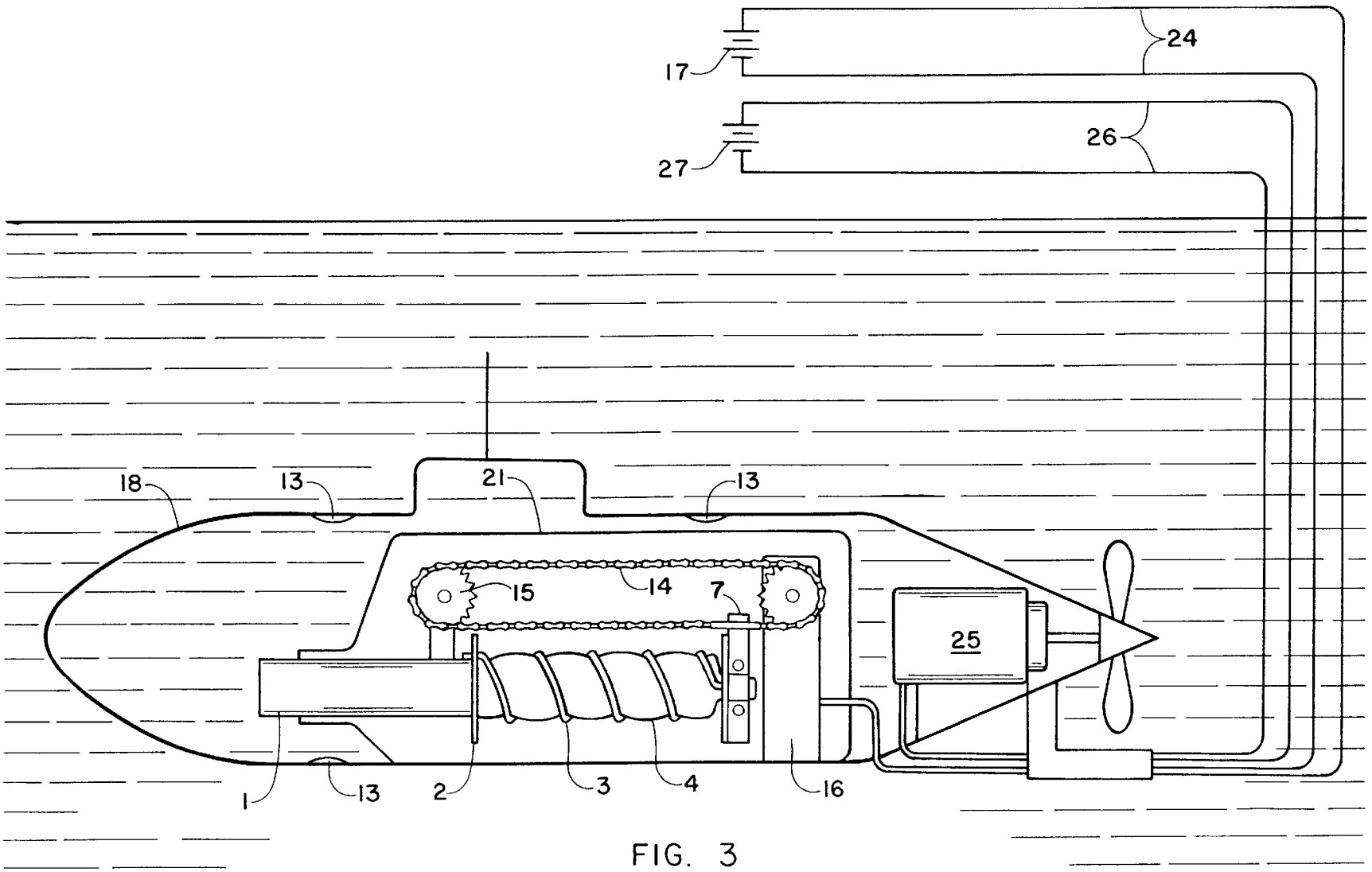
FIG. 3 is a cross-sectional side view showing the operation of the invention when being used in diving the toy submarine.

A typical application of the ballast system in a toy submarine is illustrated in FIG. 2 and FIG. 3. The ballast system is installed inside the pressure hull 21 of a wire controlled submarine. The ballast system is driven by a chain drive system. The chain drive system comprises a chain 14, sprockets 15, and a chain driving unit 16. The electricity for the driving unit 16 is provided by the batteries 17 above the water through the electric wire pair 24. The direction of rotation of the sprockets 15 can be changed by switching the polarities of the batteries 17 which powers the chain driving unit 16. The holes 13 of the external hull 18 allow water to flood the external hull 18 freely. They also allow air inside the external hull to escape.

FIG. 2 shows the operation of the ballast system when submarine surfaces. Assume the weight of the submarine has been properly adjusted, so the amount of water displaced by the ballast system is enough to sink or surface the submarine. In FIG. 2, the flexible bag 4 is compressed and water is forced out of the flexible bag. The submarine becomes lighter than the water and floats.

FIG. 3 shows the operation of the ballast system when submarine dives. In FIG. 2, the flexible bag 4 is decompressed and water is drawn into the flexible bag. The submarine becomes heavier than the water and sinks.

Figure 4:
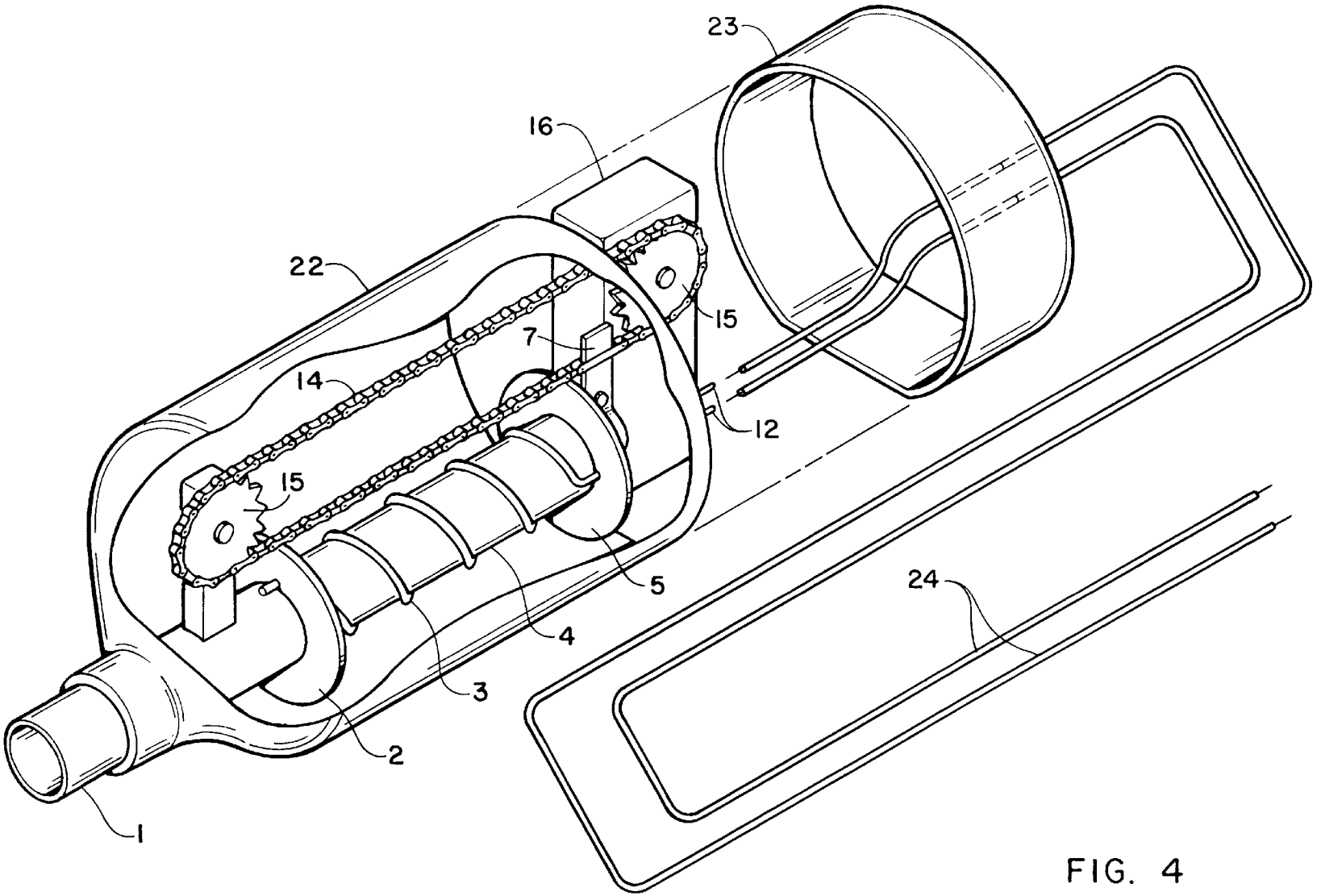
FIG. 4 is an exploded front perspective view of the pressure hull.
Figure 5:
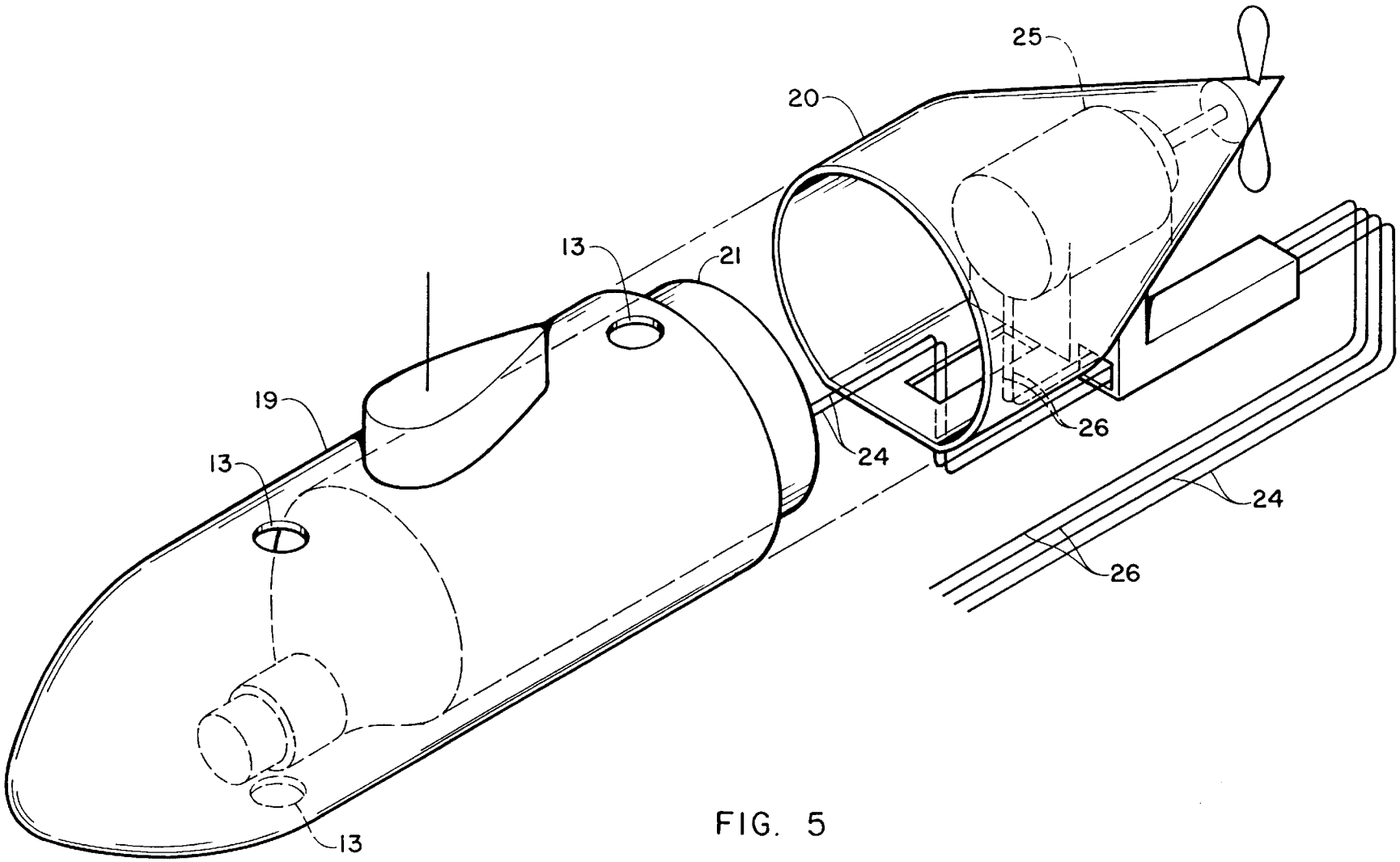
FIG. 5 is an exploded front perspective view of the external hull.

The assembly of the submarine which employs the ballast system described above is illustrated in FIG. 4 and FIG. 5. FIG. 4 shows how the pressure hull 21 is assembled. The ballast system is installed inside the front half 22. The electric wire inside the rear half 23 is connected to the electrodes 12 of the chain driving unit 16. Then, depends upon the material of the front half 22 and rear half 23, both halves can be glued or welded together to form the pressure hull 21. FIG. 5 shows the final assembly of the submarine. Pressure hull 21 is glued inside the front half 19 of the external hull 18. Then, both front half 19 and rear half 20 are glued together to form the external hull 18 of the submarine.

Having described one specific embodiment of my invention, it is obvious that various modification and alterations may be made without departing from the spirit and the scope of the invention as defined in the appended claim.

I claim:

1. A toy submarine having a flexible bag device, comprising:

a toy submarine housing;

an elongated bag for storing liquids located within the toy submarine housing;

a piece of wire for controlling a shape of said elongated bag;

a plumbing means for guiding liquids from outside into said elongated bag, said plumbing means having a straight internal passage way of a predetermined length, and said passage way of said plumbing means having a nozzle which is configured to be inserted into an opening of said elongated bag, whereby the liquid entering said plumbing means is configured to be directed to said passage way and through said nozzle into said elongated bag;

an elongated stick for controlling directions of compression and decompression action of said elongated bag, said elongated stick is longer than said elongated bag and installed inside said elongated bag, one end of the elongated stick being fixed to an end of said elongated bag, the other end of said elongated stick is inside said passage way of said plumbing means and allowed to slide back and forth inside said passage way;

means for confining the skin of said elongated bag in a limited space so that liquid inside said flexible bag can be expelled more efficiently when it is compressed;

means for fixing the end of said elongated stick to an inner end of said elongated bags;

means for bonding said piece of wire spirally around said elongated bag, whereby the shape of said elongated bag can be properly maintained.

2. The device of claim 1 wherein said plumbing means is of hollow cylindrical shape.

3. The device of claim 1 wherein said piece of wire is made of metal and coated or shielded with soft skin so said wire will not damage the skin of said elongated bag.

4. The device of claim 1 wherein said elongated stick is of hollow cylindrical shape and has holes along the stick, so liquids can leave or enter said elongated bag more efficiently through the combination of said nozzle of said plumbing means and said holes on said stick.

5. The device of claim 1 wherein said means for fixing said end of said stick to the inner end of said elongated bag further including means to connect the combination of said stick and said bag to an external driving system.

6. The device of claim 1 wherein said means for confining the skin of said elongated bag comprises two plates, one of the plates is located near said nozzle of said plumbing means, the other one of the plates is located near the end of said elongated bag.

7. A toy submarine having a flexible bag device, comprising:

a toy submarine housing;

an elongated bag for storing liquids located within the toy submarine housing;

a piece of wire for controlling the shape of said elongated bag;

a plumbing means for guiding liquids from outside into said elongated bag;

an elongated rigid object for controlling directions of compression and decompression action of said elongated bag means for confining the skin of said elongated bag in between a limited space;

means for bonding said piece of wire spirally around said elongated bag.

8. The device of claim 7 wherein said plumbing means is a rigid cylindrical tube.

9. The device of claim 7 wherein said piece of wire is made of metal and coated or enclosed with soft skin.

10. The device of claim 7 wherein said elongated rigid object for controlling the direction of the compression and decompression action of said elongated bag is a hollow rod of cylindrical shape and has holes along the length of the rod.

11. A toy submarine having a flexible bag device, comprising:

a toy submarine housing;

a bag for storing liquids located within the toy submarine housing;

a thin long object for controlling a shape of said bag;

a plumbing means for guiding liquids into said bag;

means for controlling directions of compression and decompression action of said bag;

means for confining the skin of said bag in between a limited space;

means for bonding said thin long object spirally around said bag.

12. The device of claim 11 wherein said plumbing means is a rigid tube.

13. The device of claim 11 wherein said thin long object is a piece of wire and made of metal and coated or shielded with soft skin.

14. The device of claim 11 wherein said means for controlling the direction of the compression and decompression action of said elongated bag is an elongated rigid hollow cylinder and has holes along the length of the hollow cylinder.

* * * * *